US011268669B2

(12) United States Patent
Zhou et al.

(10) Patent No.: US 11,268,669 B2
(45) Date of Patent: Mar. 8, 2022

(54) BIFOCAL LENS MODULE, VEHICLE HEADLIGHT AND VEHICLE

(71) Applicant: Zhejiang Bicom Optics Co., LTD., Jiashan (CN)

(72) Inventors: Yun Zhou, Jiashan (CN); Yanxia Fu, Jiashan (CN)

(73) Assignee: Zhejiang Bicorn Optics Co., Ltd, Zhejiang (CN)

( * ) Notice: Subject to any disclaimer, the term of this patent is extended or adjusted under 35 U.S.C. 154(b) by 0 days.

(21) Appl. No.: 16/972,604

(22) PCT Filed: Jul. 10, 2020

(86) PCT No.: PCT/CN2020/101353
§ 371 (c)(1),
(2) Date: Dec. 6, 2020

(87) PCT Pub. No.: WO2021/004532
PCT Pub. Date: Jan. 14, 2021

(65) Prior Publication Data

US 2021/0364144 A1 Nov. 25, 2021

(30) Foreign Application Priority Data

Jul. 11, 2019 (CN) ..... 201921088179.5

(51) Int. Cl.

| | |
|---|---|
| ***F21S 41/255*** | (2018.01) |
| ***F21S 41/147*** | (2018.01) |
| ***F21S 41/24*** | (2018.01) |
| ***F21S 41/32*** | (2018.01) |
| ***F21S 41/40*** | (2018.01) |

(Continued)

(52) U.S. Cl.
CPC ..... *F21S 41/255* (2018.01); *F21S 41/147* (2018.01); *F21S 41/24* (2018.01); *F21S 41/285* (2018.01); *F21S 41/322* (2018.01); *F21S 41/40* (2018.01); *F21S 41/663* (2018.01); *F21Y 2115/10* (2016.08)

(58) Field of Classification Search
CPC ..... F21S 41/255; F21S 41/24; F21S 41/663; F21S 41/147; F21S 41/322; F21S 41/40; F21S 41/285; F21Y 2115/10
USPC ..... 362/538, 543, 544, 545, 511
See application file for complete search history.

(56) References Cited

U.S. PATENT DOCUMENTS

2019/0195453 A1* 6/2019 Sakamoto ..... F21S 41/143

FOREIGN PATENT DOCUMENTS

DE 102019118968 A1 * 1/2021 ..... F21S 41/151
WO WO-2021078115 A1 * 4/2021 ..... F21S 41/285

* cited by examiner

*Primary Examiner* — Laura K Tso
(74) *Attorney, Agent, or Firm* — Raymond Y. Chan; David and Raymond Patent Firm

(57) ABSTRACT

A bifocal lens module of vehicle headlight for vehicle includes a low beam condenser, a high beam condenser, a partition, a light guide member, and an optical lens. The partition has a curvy end face and an opening. The opening of the partition faces toward the optical lens. Light emitted by at least one low beam light source is converged through the low beam condenser, then transmitted from the upper position of the partition to the bottom of the partition, and eventually sent to the lower part of the optical lens. Light emitted by at least one high beam light source is converged by the high beam condenser, transmitted from the bottom of the partition through the light guide channel to the top of the partition, and then sent to the upper part of the optical lens.

20 Claims, 6 Drawing Sheets

(51) Int. Cl.

| | |
|---|---|
| ***F21S 41/663*** | (2018.01) |
| ***F21S 41/20*** | (2018.01) |
| ***F21Y 115/10*** | (2016.01) |

BIFOCAL LENS MODULE, VEHICLE HEADLIGHT AND VEHICLE

CROSS REFERENCE OF RELATED APPLICATION

This is a non-provisional application U.S. National Stage under 35 U.S.C. 371 of the International Application Number PCT/CN2020/101353, filed Jul. 10, 2020, which is incorporated herewith by reference in its entirety.

BACKGROUND OF THE PRESENT INVENTION

Field of Invention

The present invention relates to the field of optics, and in particular, to bifocal lens module, vehicle headlight, and vehicle.

Description of Related Arts

Vehicle headlights are the eyes of a vehicle, which are closely related with the safety of nighttime driving or driving under heavy weather. Most current vehicle headlights utilize LED bifocal lens, which allows the vehicle headlight to switch between a low beam mode and a high beam mode by means of a movable switching mechanism.

Specifically speaking, it utilizes a movable baffle to mask the high beam emitted by the LED into a low beam. Therefore, the operating frequency of the light source can maintain constant for both high beam and low beam.

Unfortunately, such type of vehicle headlight has several drawbacks. First, when the vehicle is driven at night, the switching between low beam and high beam can be quite frequent and the movable baffle has to perform its masking to the light source through a mechanical and/or electronic mechanism. In order to serve a high frequency use, a movable baffle of relatively high reliability is demanded, which refers to an increased cost. In addition, whether for the high beam mode or the low beam mode, the operating frequency of the light source still remains the same, which is in a relatively high output. This will reduce the service life of the light source to some extent.

SUMMARY OF THE PRESENT INVENTION

An object of the present invention is to provide a bifocal lens module of vehicle headlight for vehicle, wherein the vehicle headlight utilizes low beam light source(s) and high beam light source(s) in correspondence to a low beam mode and a high beam mode.

Another object of the present invention is to provide a bifocal lens module of vehicle headlight for vehicle, wherein the switching between the low beam mode and the high beam mode of the vehicle headlight does not require complicated mechanism.

Another object of the present invention is to provide a bifocal lens module of vehicle headlight for vehicle, wherein the parts of the vehicle headlight is integrated, so as to facilitate the mounting or dismounting thereof.

Another object of the present invention is to provide a bifocal lens module of vehicle headlight for vehicle, wherein the parts of the vehicle headlight can be light weighted.

Another object of the present invention is to provide a bifocal lens module of vehicle headlight, for vehicle, wherein the parasitic light produced by the low beam light source of the vehicle headlight during the lightening process can be reduced.

According to an aspect of the present invention, the present invention provides a bifocal lens module, including:

a low beam condenser;

a high beam condenser;

an optical lens; and a light guide unit, having a curvy end face and an opening, wherein the curvy end face surroundingly forms and defines the opening, wherein the light guide unit defines a light guide channel and a light outlet communicated with the light guide channel, allowing light to leave the light outlet in a manner of being transmitted in the light guide channel along an upper inclined direction facing toward a focal point of the optical lens, wherein a light emitted by at least a low beam light source is converged through the low beam condenser, transmitted from an upper position of the light guide unit to a bottom of the light guide unit through the opening, and then the light is sent to a lower part of the optical lens, wherein a light emitted by at least a high beam light source is converged by the high beam condenser, transmitted from a lower position of the light guide unit to a top of the light guide unit through the light guide channel, and then the light is sent to an upper part of the optical lens.

According to some embodiments of the present invention, the light guide unit includes a partition and a light guide member, wherein the opening is formed and defined on the partition, wherein the light guide channel is arranged at the light guide member, wherein the light outlet is on the light guide member.

According to some embodiments of the present invention, the light guide member is a solid structure.

According to some embodiments of the present invention, the light guide member is a hollow structure, wherein the light guide channel passes through the light guide member.

According to some embodiments of the present invention, the light guide unit is integrally formed.

According to some embodiments of the present invention, the light guide unit is transparent.

According to some embodiments of the present invention, the light guide unit is made of transparent plastic material.

According to some embodiments of the present invention, the light guide unit includes a shade layer, arranged on the upper surface of the light guide unit.

According to some embodiments of the present invention, the partition of the light guide unit is made of opaque material.

According to some embodiments of the present invention, the light guide unit has a bottom surface, wherein the distance between the bottom surface and the central axis of the optical lens is arranged to be gradually reduced when closer to the light outlet.

According to another aspect of the present invention, the present invention provides a vehicle headlight, including:

a bifocal lens module, which comprises;

a low beam condenser, a high beam condenser, an optical lens, and a light guide unit, having a curvy end face and an opening, wherein the curvy end face surroundingly forms and defines the opening, wherein the light guide unit defines a light guide channel and a light outlet communicated with the light guide channel, allowing a light to leave the light outlet in a manner of being transmitted in the light guide channel along an upper inclined direction facing toward a focal point of the optical lens;

at least one low beam light source, arranged on an upper side of the light guide unit, so as for emitting the light above the bifocal lens module, such that the light is converged through the low beam condenser, passing through the focal point of the optical lens and reaching a lower part of the optical lens; and at least one high beam light source, arranged on a lower side of the light guide unit, so as for emitting the light below the bifocal lens module, such that the light is converged through the high beam condenser, passing through the focal point of the optical lens, and reaching an upper part of the optical lens, wherein the light emitted by the at least one low beam light source is converged through the low beam condenser, transmitted from an upper position of the light guide unit to a bottom of the light guide unit through the opening, and then the light is sent to the lower part of the optical lens, wherein the light emitted by the at least one high beam light source is converged by the high beam condenser, transmitted from a lower position of the light guide unit to a top of the light guide unit through the light guide channel, and then the light is sent to the upper part of the optical lens.

According to some embodiments of the present invention, the vehicle headlight has a low beam mode and a high beam mode, wherein the low beam light source is lightened in the low beam mode, while both the high beam light source and the low beam light source are lightened in the high beam mode, wherein the vehicle headlight is operably switched between the low beam mode and the high beam mode.

According to some embodiments of the present invention, the low beam light source is arranged on the upper side of the light guide unit in an inclined manner facing toward the light guide unit, so as to allow the light to be transmitted from the above of the light guide unit to the underneath of the light guide unit, wherein the high beam light source is arranged on the lower side of the light guide unit in an inclined manner facing toward the light guide unit, so as to allow the light to be transmitted from the underneath of the light guide unit to the above of the light guide unit.

According to another aspect of the present invention, the present invention provides a vehicle, including:

a vehicle main body; and one or more vehicle headlights, mounted on a front of the vehicle main body, wherein each of the vehicle headlights includes:

a bifocal lens module, which comprises;

a low beam condenser, a high beam condenser, an optical lens, and a light guide unit, having a curvy end face and an opening, wherein the curvy end face surroundingly forms and defines the opening, wherein the light guide unit defines a light guide channel and a light outlet communicated with the light guide channel, allowing a light to leave the light outlet in a manner of being transmitted in the light guide channel along an upper inclined direction facing toward a focal point of the optical lens;

at least one low beam light source, arranged on an upper side of the light guide unit, so as for emitting the light above the bifocal lens module, such that the light is converged through the low beam condenser, passing through the focal point of the optical lens and reaching a lower part of the optical lens; and at least one high beam light source, arranged on a lower side of the light guide unit, so as for emitting the light below the bifocal lens module, such that the light is converged through the high beam condenser, passing through the focal point of the optical lens, and reaching an upper part of the optical lens, wherein the light emitted by the at least one low beam light source is converged through the low beam condenser, transmitted from an upper position of the light guide unit to a bottom of the light guide unit through the opening, and then the light is sent to the lower part of the optical lens, wherein the light emitted by the at least one high beam light source is converged by the high beam condenser, transmitted from a lower position of the light guide unit to a top of the light guide unit through the light guide channel, and then the light is sent to the upper part of the optical lens.

According to some embodiments of the present invention, the vehicle headlight has a low beam mode and a high beam mode, wherein the low beam light source is lightened in the low beam mode, while both the high beam light source and the low beam light source are lightened in the high beam mode, wherein the vehicle headlight is operably switched between the low beam mode and the high beam mode.

According to some embodiments of the present invention, the low beam light source is arranged on the upper side of the light guide unit in an inclined manner facing toward the light guide unit, so as to allow the light to be transmitted from the above of the light guide unit to the underneath of the light guide unit, wherein the high beam light source is arranged on the lower side of the light guide unit in an inclined manner facing toward the light guide unit, so as to allow the light to be transmitted from the underneath of the light guide unit to the above of the light guide unit.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Figure 1:
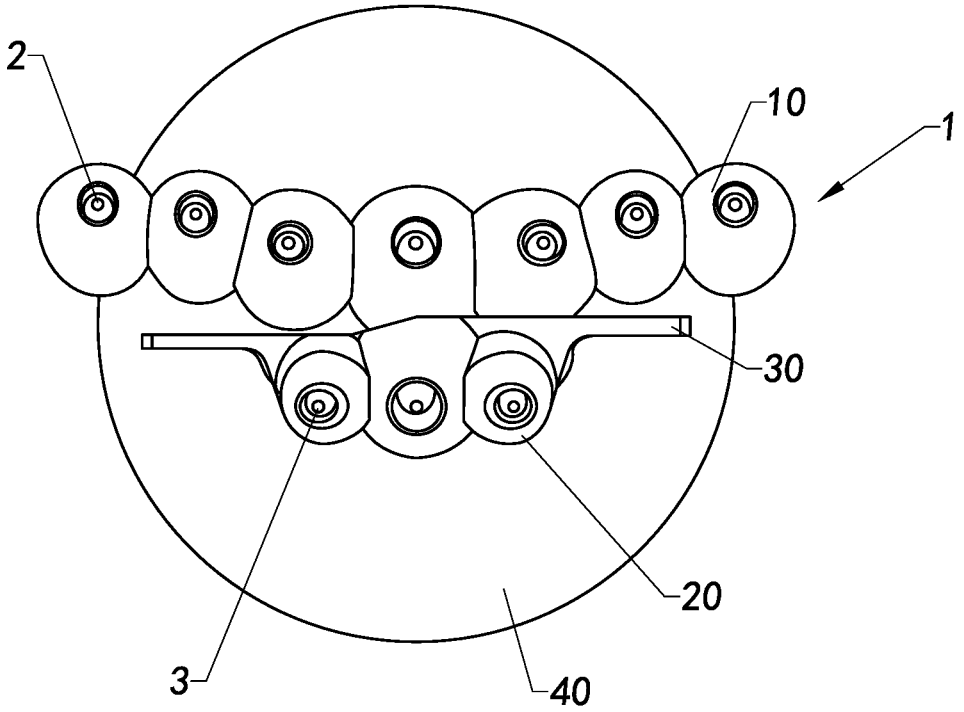
FIG. 1 is a perspective view of a bifocal lens module according to a preferred embodiment of the present invention.
Figure 2:
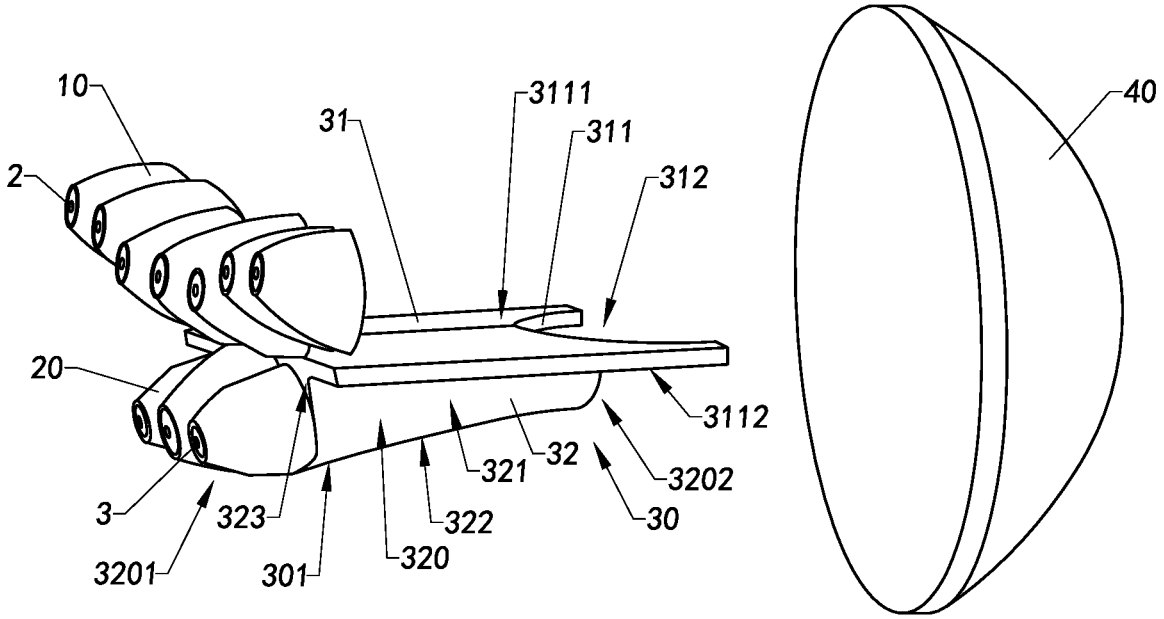
FIG. 2 is a perspective view of the bifocal lens module according to the above preferred embodiment of the present invention.

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Those skilled in the art should understand that, in the disclosure of the present invention, terminologies of "longitudinal," "lateral," "upper," "front," "back," "left," "right," "perpendicular," "horizontal," "top," "bottom," "inner," "outer," and etc. just indicate relations of direction or position are based on the relations of direction or position shown in the appended drawings, which is only to facilitate descriptions of the present invention and to simplify the descriptions, rather than to indicate or imply that the referred device or element must apply specific direction or to be operated or configured in specific direction. Therefore, the above-mentioned terminologies shall not be interpreted as confine to the present invention.

It is understandable that the term "a" should be understood as "at least one" or "one or more". In other words, in one embodiment, the number of an element can be one and in other embodiment the number of the element can be greater than one. The term "a" is not construed as a limitation of quantity.

Referring to FIGS. 1-6B, a bifocal lens module according to a preferred embodiment of the present invention is illustrated. The bifocal lens module 1 is adapted to be utilized along and equipped with at least one low beam light source 2 and at least one high beam light source 3, so as to provide low beam and high beam in different modes.

Specifically speaking, the bifocal lens module 1 comprises a low beam condenser 10, a high beam condenser 20, a light guide unit 30, and an optical lens 40. A low light emitted by the at least one low beam light source 2 is sent into the low beam condenser 10 and then radiated to the optical lens 40, while the low light emitted by the high beam light source 3 is sent into the high beam condenser 20 and then radiated to the optical lens 40.

The light guide unit 30 comprises a partition 31 and a light guide member 32. The partition 31 is arranged between the low beam condenser 10 and the high beam condenser 20. The partition 31 is for forming a cut-off line of the light and a shade of the low beam. The light guide member 32 is disposed below the partition 31. A high light emitted by the at least one high beam light source 3 passes through a light guide channel 320 formed and defined by the light guide member 32, passes through the partition 31, and reaches the optical lens 40.

In detail, the low beam condenser 10 is arranged on an upper side of the partition 31, while the high beam condenser 20 is arranged on a lower side of the partition 31. The low light emitted by the at least one low beam light source 2 from a top downward in an inclined manner passes by the partition 31 and passes through the optical lens 40.

The high light emitted by the high beam light source 3 from a bottom up passes by the light guide channel 320 of the light guide member 32, passes by the partition 31, and passes through the optical lens 40.

The light guide unit has a curvy end face 311 and an opening 312. The curvy end face 311 surroundingly forms and defines the opening 312. The light guide unit 30 defines a light guide channel 320 and a light outlet 3202 that is communicated with the light guide channel 320, allowing a light to leave the light outlet 3202 in a manner of being transmitted in the light guide channel 320 along an upper inclined direction facing toward a focal point of the optical lens 40. The low light emitted by the at least one low beam light source 2 is converged through the low beam condenser 10, transmitted from an upper position of the light guide unit 30 to a bottom of the light guide unit 30 through the opening 312, and then the low light is sent to a lower part of the optical lens 40. The high light emitted by the at least one high beam light source 3 is converged by the high beam condenser 20, transmitted from a lower position of the light guide unit 30 to a top of the light guide unit 30 through the light guide channel 320, and then the high light is sent to an upper part of the optical lens 40.

Specifically speaking, the partition 31 has the curvy end face 311 and the opening 312, wherein the curvy end face 311 forms and defines the opening 312. The light emitted by the at least one low beam light source 2 can pass through the opening 312 and create a cut-off line of the light and shade of the low beam under the influence of the partition 31.

The light emitted by the high beam light source 3 can pass through the opening 312, reaching the optical lens 40 and passing through the optical lens 40 to be radiated outward.

The opening 312 can be a U-shaped opening. According to some other implementations of the present embodiment, the curvature of the curvy end face 311 corresponding to the opening 312 is gradually expanded or reduced from a middle position to the two end positions. The curvy end face 311 may also be in a fluctuation shape, such as a wave shape and etc. Person skilled in the art should understand that this is just an example.

It is worth noted that the at least one low beam light source 2 is arranged and faced downward in an inclined manner and the low beam condenser 10 is also arranged and faced downward in an inclined manner, such that the light emitted by the at least one low beam light source 2 can pass through the low beam condenser 10 and follow the downward and inclined direction to reach the lower part of the optical lens 40. The at least one high beam light source 3 is arranged and faced upward in an inclined manner and the high beam condenser 20 is also arranged and faced upward in an inclined manner such that the light emitted by the at least one high beam light source 3 can pass through the high beam condenser 20 and follow the upward and inclined direction to reach the upper part of the optical lens 40. It is worth noted that the upward inclined or downward inclined is according to the partition 31 as the basis.

Certainly, the at least one low beam light source 2 and the at least one high beam light source 3 may not be particularly arranged in an inclined manner. For instance, the at least one low beam light source 2 and the at least one high beam light source 3 may also respectively be arranged in an upright manner, so as for radiating light of the vertical direction and the at least one low beam light source 2 and the at least one high beam light source 3 may also be respectively disposed on the upper side and lower side of the partition 31. The low beam condenser 10 and the high beam condenser 20 may also be arranged in an inclined manner, such that the light emitted by the at least one low beam light source 2 can be condensed or reflected through the low beam condenser 10 and then transmitted in a downward inclined manner toward the optical lens 40 and the light emitted by the at least one high beam light source 3 can be condensed or reflected through the high beam condenser 20 and then transmitted in an upward inclined manner toward the optical lens 40.

The light emitted by the at least one low beam light source 2 passes through the opening 312 of the partition 31 from the above of the partition 31 to the underneath of the partition 31 and then reaches the lower part of the optical lens 40 so as to achieve the result of low beam.

The light emitted by the at least one high beam light source 3 passes through the opening 312 of the partition 31 from the underneath of the partition 31 to the above of the partition 31 and then reaches the upper part of the optical lens 40 so as to achieve the result of high beam.

The light guide member 32 is arranged below the partition 31 and forms and defines the light guide channel 320. The light emitted by the at least one high beam light source 3 is transmitted in the light guide channel 320 along an upward inclined light path to pass through the partition 31 and reaches the optical lens 40.

The light guide member 32 has an inner wall. The inner wall of the light guide member 32 and the partition 31 forms and defines the light guide channel 320. The inner wall of the light guide member 32 and the partition 31 also forms and defines a light outlet 3202. At least a part of the light emitted by the at least one high beam light source 3 passed through the light outlet 3202 of the light guide member 32 passes through the opening 312 of the partition 31. Certainly, it is understandable that the light outlet 3202 may also be formed and defined by the light guide member 32 alone.

It is understandable that the light outlet 3202 may also be a space formed and defined by a surrounding solid object or a virtual outlet, such as that when the light guide member 32 is made of transparent material, the light can directly pass through the light guide member 32. In other words, the light guide member 32 may be a solid structure and the light is totally reflected within the light guide member 32 and leaves the light guide member 32 from the position of the light outlet 3202. Alternatively, the light guide member 32 may be a hollow structure and the light is transmitted within the light guide channel 320 and leaves the light guide member 32 from the position of the light outlet 3202.

When the light guide member 32 is a hollow structure, the inner wall of the light guide member 32 can be coated with a reflective layer, so as to allow the light to be transmitted within the light guide channel 320 toward the light outlet 3202. Optionally, the light guide member 32 may have an aluminum coating.

When the bifocal lens module 1 is utilized on a vehicle 1000, the bifocal lens module 1 has a low beam mode and a high beam mode which are switchable. For the low beam mode, the low beam light source 2 is lightened. The light emitted by the at least one low beam light source 2 first passes through the low beam condenser 10, then passes through the partition 31, and reaches the lower part of the optical lens 40, so as to create a low beam with light and shade.

For the high beam mode, both the at least one low beam light source 2 and the at least one high beam light source 3 are lightened at the same time. The light emitted by the at least one low beam light source 2 first passes through the low beam condenser 10, then passes through the partition 31, and reaches the lower part of the optical lens 40. The light emitted by the at least one high beam light source 3 sequentially passes through the high beam condenser 20, the light guide member 32, and the partition 31 and then reaches the upper part of the optical lens 40 so as to perform a high beam result.

Figure 5A:
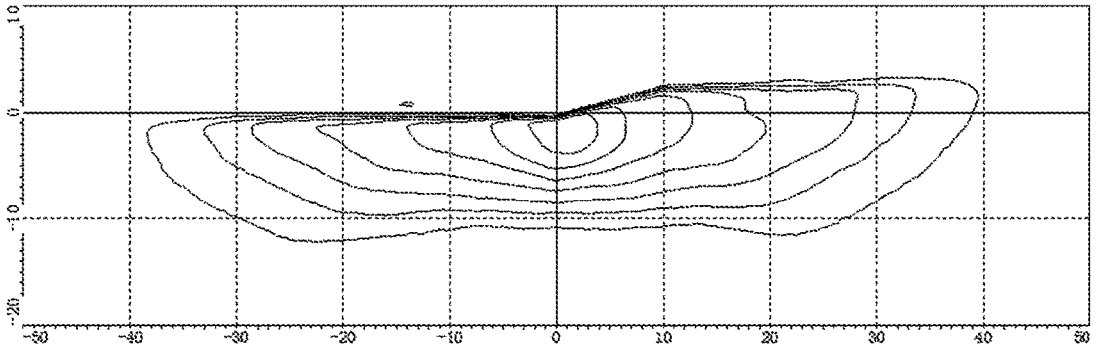
FIG. 5A is diagram illustrating a low beam screen light distribution of the application of the bifocal lens module according to the above preferred embodiment of the present invention.
Figure 5B:
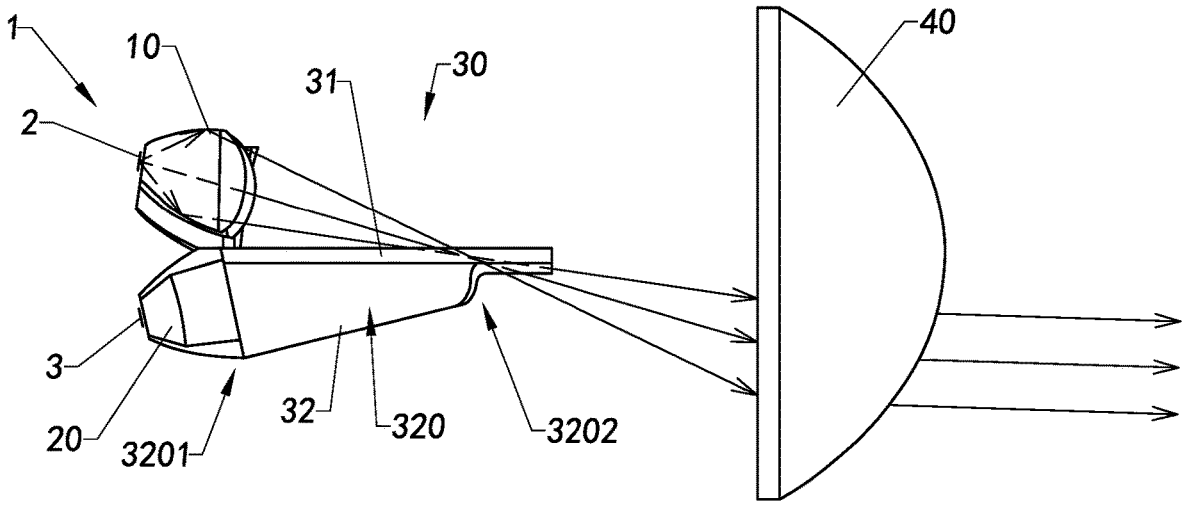
FIG. 5B is a perspective view of the light of the low beam application of the bifocal lens module according to the above preferred embodiment of the present invention.
Figure 6A:
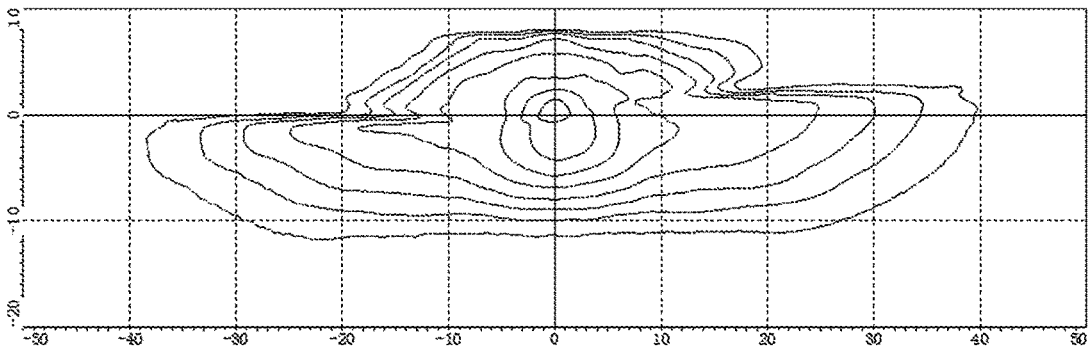
FIG. 6A is a diagram illustrating a high beam screen light distribution of the application of the bifocal lens module according to the above preferred embodiment of the present invention.
Figure 6B:
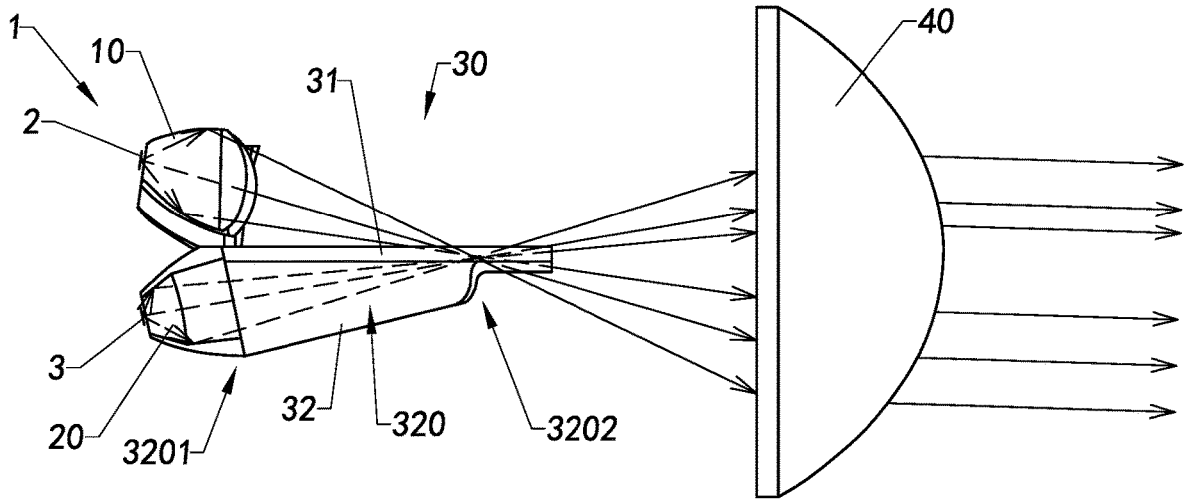
FIG. 6B is a perspective view of the light of the high beam application of the bifocal lens module according to the above preferred embodiment of the present invention.

Referring to FIG. 5A, a result of the low beam mode is illustrated. Referring to FIG. 6A, a result of the high beam mode is illustrated.

When it is under the high beam mode, because the at least one low beam light source 2 and the at least one high beam light source 3 are both lightened and the light emitted by the at least one low beam light source 2 is transmitted in a downward inclined manner, while the light emitted by the at least one high beam light source 3 is transmitted in an upward inclined manner. Therefore, the light emitted by the at least one low beam light source 2 may interfere the light emitted by the at least one high beam light source 3.

According to the present embodiment, the light guide member 32 is arranged to be made of transparent material and the partition 31 is coordinately designed to reduce the parasitic light when the light of the at least one low beam light source 2 passes by the partition 31, so as to benefit the lighting result of the high beam formed eventually under the high beam mode.

Further, the bifocal lens module 1 may not only form a horizontal cut-off line of the light and shade, but also form a cut-off line of the light and shade in a certain angle during the use thereof.

Figure 3:
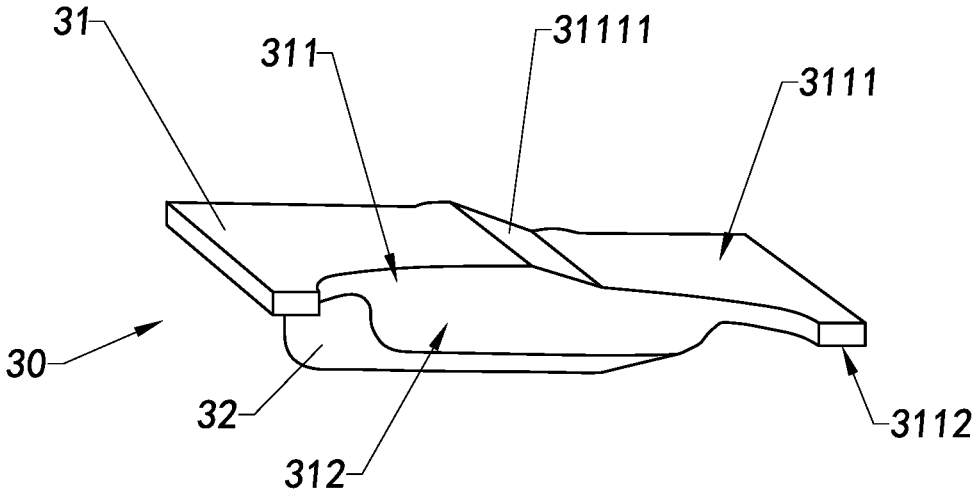
FIG. 3 is a perspective view of a side of an optical lens of a light guide unit of the bifocal lens module according to the above preferred embodiment of the present invention.
Figure 4:
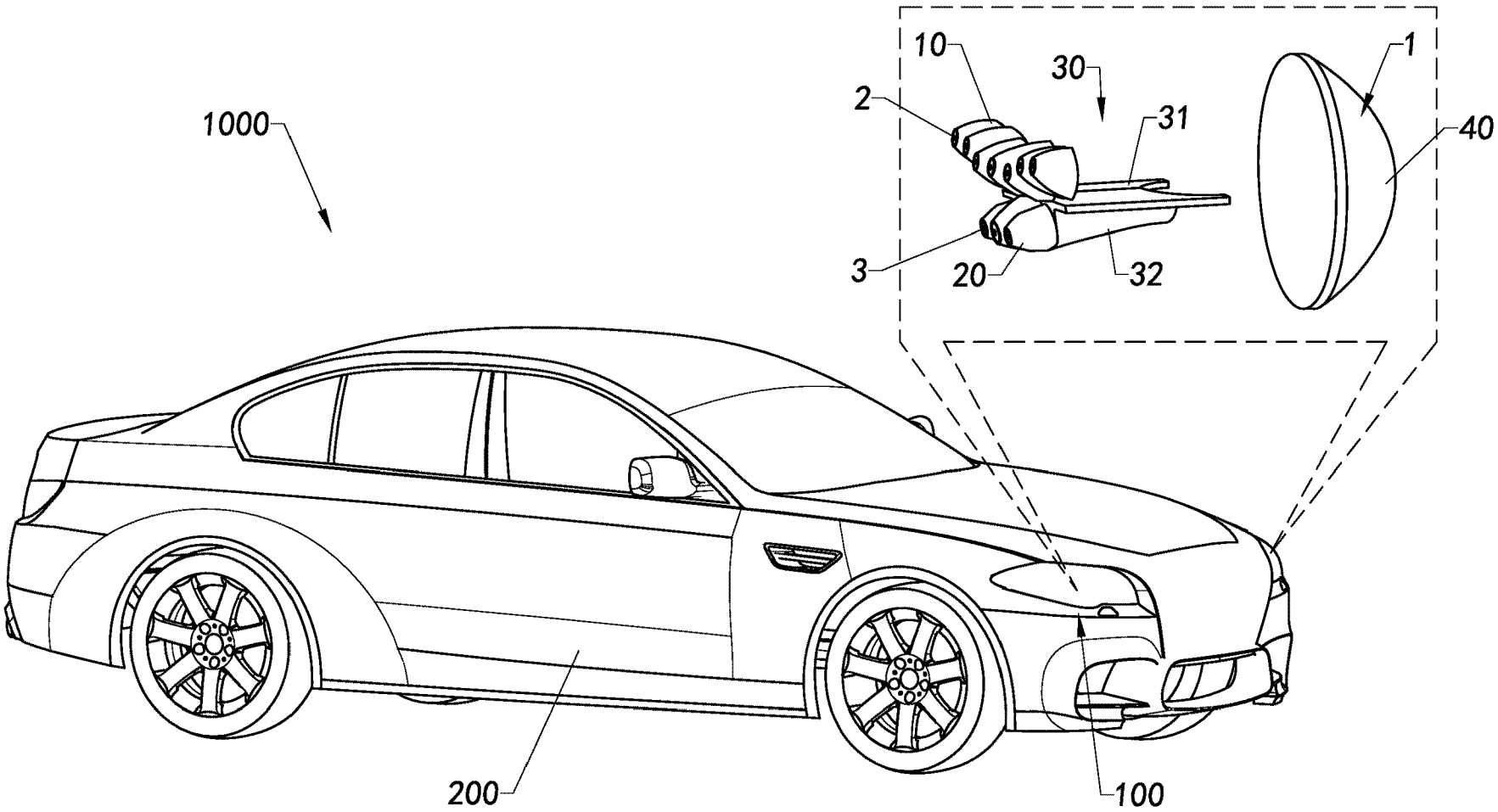
FIG. 4 is a schematic view illustrating an application of the bifocal lens module according to the above preferred embodiment of the present invention.

Specifically speaking, referring to FIG. 3, the partition 31 of the light guide unit 30 has an upper surface 3111 and a lower surface 3112. The upper surface 3111 and the lower surface 3112 of the partition 31 are arranged opposite to each other and if the partition 31 is at a horizontal position, the curvy end face 311 of the partition 31 is for forming a horizontal cut-off line of the light and shade. The upper surface 3111 of the partition 31 forms an inclined plane 31111. The inclined plane 31111 is arranged in a certain angle, such as 15, 45 or 90 degrees, to the horizontal position, so as to achieve an inclined cut-off line of the light and shade for the illumination result.

Optionally, the opening 312 formed and defined by the partition 31 of the light guide unit 30 may be divided equally along the central axis of the optical lens 40. The central axis of the optical lens 40 refers to an axial line that passes through the focal point and a center of the optical lens 40.

Optionally, the inclined plane 31111 is located on a side of the central axis of the optical lens 40. If one observes from a side of the light guide unit 30 along the optical lens 40, s/he may find a height difference at the upper surface 3111 of the partition 31 of the light guide unit 30.

The bifocal lens module 1 has a focal point O. The focal point O is at a position on the partition 31 behind the optical lens 40 of the bifocal lens module 1.

At least a part of the light emitted by the at least one low beam light source 2 is converged at the focal point O and at least a part of the light emitted by the at least one high beam light source 3 is converged at the focal point O, so as to form the high beam.

The low beam condenser 10 and the high beam condenser 20 can respectively converge and condense the light. A reflection side of the low beam condenser 10 is arranged in an inclined manner so as to converge the light emitted by the at least one low beam light source 2 downward in an inclined manner. A reflection side of the high beam condenser 20 is arranged in an inclined manner so as to converge the light emitted by the at least one high beam light source 3 upward in an inclined manner.

It is understandable that the reflection side of the low beam condenser 10 may be a curved surface and the reflection side of the high beam condenser 20 may also be a curved surface.

The focal point O of the bifocal lens module 1 can be arranged at the position at the opening 312 of the partition 31.

According to some other embodiments of the present invention, the partition 31 may be made of opaque material, such as metal or other materials. The light emitted by the at least one low beam light source 2 is transmitted from the upper side of the partition 31 to the other side of the partition 31 and at least a part of the light is converged at the focal point O of the bifocal lens module 1.

When the partition 31 is made of opaque material, its thickness can be relatively thinner, into, for example, 1 mm or thinner, so as to reduce its influence to the light.

The position of the low beam condenser 10, the position of the partition 31, and the position of the bifocal lens module 1 have to be specifically disposed, so as to allow the light emitted by the at least one low beam light source 2 and reflected by the low beam condenser 10 to be converged by the partition 31 to reach the bifocal lens module 1, so as to eventually achieve a lighting result with a cut-off line of the light and shade.

The curvy end face 311 of the partition 31 has an angle, so as to benefit the transmitting of the light of the low beam light source 2 and the transmission result thereof. Optionally, the curvy end face 311 requires a sharp angle formed with the plane where the partition 31 is located.

In detail, the curvy end face 311 can provide a certain blocking function when at least a part of the light of the at least one low beam light source 2 is passing through the opening 312 of the partition 31, so as for forming the cut-off line of the low beam.

When the light of the at least one low beam light source 2 passes through the partition 31, it passes through the opening 312 in an inclined manner. The curvy end face 311 is also arranged in an inclined manner and the incline is about consistent to the transmission direction of the light, so as to help to reduce the parasitic light produced at this position.

The angle of the curvy end face 311 can be controlled and decided through slicing or cutting technologies. For example, when the entire partition 31 is provided, the angle that the curvy end face 311 is arranged can be controlled through slicing or cutting technologies based on the overall imaging performance of the bifocal lens module 1.

Further, at least part of the light emitted by the at least one high beam light source 3 passed the light guide member 32 is converged at the focal point O and reach the upper part of the optical lens 40.

The light outlet 3202 of the light guide member 32 is arranged near by the opening 312, so as to allow the light inclinedly projected from the light outlet 3202 passing through the opening 312 to reach the upper part of the optical lens 40.

It is worth noted that the light outlet 3202 of the light guide member 32 is arranged below the opening 312 of the partition 31 and the light outlet 3202 of the light guide member 32 may be positioned at the same vertical direction with a middle position of the curvy end face 311 that forms the opening 312. The middle position of the curvy end face 311 refers to the farthest position on the curvy end face 311 from the optical lens 40.

According to some embodiments of the present invention, it may also be that the light outlet 3202 of the light guide member 32 is arranged below the opening 312 of the partition 31, but the distance between the light outlet 3202 of the light guide member 32 and the optical lens 40 is lightly less than the distance between the middle position of the curvy end face 311 that forms the opening 312 and the optical lens 40. Alternatively, the light outlet 3202 of the light guide member 32 is arranged below the opening 312 of the partition 31, but the distance between the light outlet 3202 of the light guide member 32 and the optical lens 40 is equal to the focal length of the optical lens 40.

The light guide channel 320 is formed and defined between the partition 31 and an inner wall of the light guide member 32 and a lateral section of the light guide channel 320 is arranged to be gradually smaller when further approaching the light outlet 3202.

For the light emitted by the at least one high beam light source 3 under the influence of the high beam condenser 20, the light emitted by the at least one high beam light source 3 is transmitted along an upward inclined direction and mainly converged to the position of the focal point O of the optical lens 40. Therefore, the transmission path of the light of the high beam light source 3 is a path mainly in a far-broad-close-narrow manner. The light path is broader at the position closer to the high beam condenser 20, while the light path is narrower at the position closer to the light outlet 3202.

Further, according to the present embodiment, the light guide member 32 comprises two wings 321 and a floor 322. The two wings 321 are respectively arranged at the two sides of the floor 322. The light inlet 3201 and the light outlet 3202 are respectively at the two sides of the floor 322. The floor 322 is arranged below the partition 31. Besides, a certain distance is kept between the floor 322 and the partition 31. The distance between the floor 322 and the partition 31 becomes smaller as it gets closer to the light outlet 3202.

In other words, the light guide unit 30 has a bottom surface 301. The bottom surface 301 is an outer surface of the floor 322 of the light guide member 32. The distance between the bottom surface 301 of the light guide unit 30 and the central axis of the optical lens becomes smaller when closer to the light outlet 3202.

It is worth noted that when the light guide member 32 is a solid structure and the light guide member 32 is arranged closer to the light outlet 3202, the lateral section of the light guide member 32 will be smaller. When the light guide member 32 is a hollow structure and the light guide channel 320 of the light guide member 32 is arranged closer to the light outlet 3202, the inside diameter of the light guide channel 320 will be smaller.

The light guide member 32 may also comprise a mounting plant 323. The light inlet 3201 is formed on the mounting plant 323. The mounting plant 323 is arranged on a side of the floor 322. The mounting plant 323 and the floor 322 form and define an included angle of a certain angle therebetween.

According to the present embodiment, the floor 322 is a curvy plate. The surface of the floor 322 is a curved surface. The high beam condenser 20 is mounted on the mounting plant 323.

According to some other embodiments of the present invention, the floor 322 is a plane plate. The surface of the floor 322 is a plane surface.

For the entire light guide member 32, it equals to form an inverted triangle structure and the inverted triangle structure may have a right angle or a round corner.

Optionally, the structural design of the light guide member 32 and the way for the light emitted by the at least one high beam light source 3 may be remain consistent, such that most of the light emitted by the at least one high beam light source 3 can pass through the focal point O of the optical lens 40 after passing through the light guide member 32, then the light can reach the optical lens 40 and image.

Further, according to the present embodiment, the at least one high beam light source 3 is symmetrically arranged so as to benefit the final illumination result. For example, the partition 31 can be an axisymmetric structure, which utilizes the central axis of the optical lens 40 as the boundary and a plurality of the high beam light source 3 are symmetrically disposed. According to the present embodiment, the quantity of the at least one high beam light source 3 is three.

The at least one low beam light source 2 is symmetrically disposed, such as that a plurality of the low beam light sources 2 are symmetrically arranged based on the axial line of the partition 31 as the boundary, so as to benefit the final illumination result. According to the present embodiment, the quantity of the low beam light sources 2 is six.

Person skilled in the art should be able to understand that the quantities of the high beam light source 3 and the low beam light source 2 are examples rather than limits to the present invention. Person skilled in the art may change the quantities of the high beam light source 3 and the low beam light source 2 based on the actual needs.

Further, the low beam condenser 10 and the at least one low beam light source 2 are arranged corresponding to each other. For example, one of the low beam light sources 2 has one of the low beam condensers 10 arranged correspondingly. Alternatively, a plurality of the low beam light sources 2 have only one of the low beam condensers 10 arranged correspondingly. When there are more than one low beam condensers 10, adjacent low beam condensers 10 may be independent or connected with each other.

The high beam condenser 20 and the high beam light source 3 are arranged corresponding to each other. For example, one of the high beam light sources 3 has one of the high beam condensers 20 arranged correspondingly. Alternatively, a plurality of the high beam light sources 3 have only one of the high beam condensers 20 arranged correspondingly. When there are more than one high beam condensers 20, adjacent high beam condensers 20 may be independent or connected with each other.

Further, according to the present embodiment, the manufacturing manner of the partition 31 may be integrally forming or forming through cutting.

The partition 31 can be made of metallic material, such as being formed through cutting a rectangle metallic material and forming the opening 312 through cutting. Alternatively, it may also be directly formed through casting. The upper surface of the partition 31 may also be coated and plated with aluminum, so as to enhance the efficiency of light inlet and benefit the final illumination result.

According to another aspect of the present invention, the present invention provides a vehicle 1000, which comprises a vehicle main body 200 and at least a vehicle headlight 100 mounted in front of the vehicle main body 200. The vehicle headlight 100 comprises the at least one high beam light source 3, the at least one low beam light source 2, and the bifocal lens module 1. The bifocal lens module 1 has two modes, namely the low beam mode and the high beam mode. Under the low beam mode, the at least one low beam light source 2 is lightened and the light emitted by the at least one low beam light source 2 passes through the optical lens 40 of the bifocal lens module 1. Under the high beam mode, both the at least one low beam light source 2 and the at least one high beam light source 3 are lightened at the same time. Then the light emitted by the at least one high beam light source 3 passes through the lower part of the optical lens 40 of the bifocal lens module 1, while the light emitted by the at least one low beam light source 2 passes through the upper part of the optical lens 40 of the bifocal lens module 1.

According to another aspect of the present invention, the present invention provides the vehicle headlight 100. The vehicle headlight 100 comprises the at least one low beam light source 2, the at least one high beam light source 3, and the bifocal lens module 1. The at least one low beam light source 2 and the at least one high beam light source 3 are respectively mounted at designated positions on the bifocal lens module 1, so as for achieving desired illumination results. It is understandable that the at least one low beam light source 2 and the at least one high beam light source 3 may be not mounted on the bifocal lens module 1. Instead, the at least one low beam light source 2, the at least one high beam light source 3, and the bifocal lens module 1 may be respectively arranged at predetermined positions. In other words, the at least one low beam light source 2, the at least one high beam light source 3, and the bifocal lens module 1 are held at relatively secure positions through other means, so as for the whole vehicle headlight 100 to achieve desired illumination results.

Figure 7:
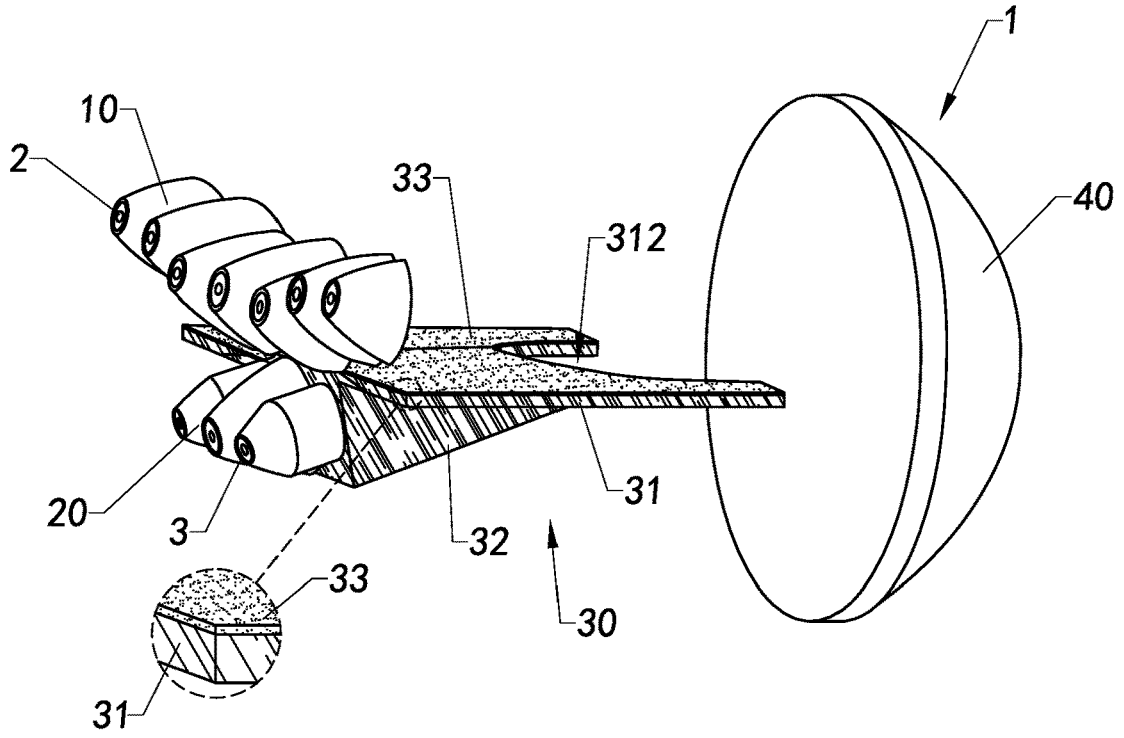
FIG. 7 is a perspective view of the bifocal lens module according to an alternative mode of the above preferred embodiment of the present invention.

Referring to FIG. 7, the bifocal lens module 1 according to an alternative mode of the above preferred embodiment of the present invention is illustrated.

According to the alternative mode of the above preferred embodiment of the present invention, the partition 31 and the light guide member 32 of the bifocal lens module 1 are both transparent, wherein the partition 31 has an upper surface and a lower surface, wherein the upper surface and the lower surface of the partition 31 are arranged opposite to each other.

The light guide member 32 is arranged on the lower surface of the partition 31. A shade layer 33 is arranged on the upper surface of the partition 31.

The light of the low beam light source 2 is projected from the top downward from the above of the partition 31 to pass through the opening 312 of the partition 31. After the light emitted by the low beam light source 2 passed through the low beam condenser 10, the light may directly enter the partition 31 and interfere the light emitted by the high beam light source 3 below the partition 31. Therefore, the shade layer 33 arranged on the upper surface of the partition 31 is helpful for reducing the parasitic light produced by the low beam light source 2 at the partition 31.

For another approach, when it is under the high beam mode, the light produced by the low beam light source 2 is transmitted to the optical lens 40 from the top downward, while the light produced by the high beam light source 3 is transmitted to the optical lens 40 from the bottom upward. Because, the partition 31 and the light guide member 32 are both transparent, the shade layer 33 arranged on the partition 31 will be capable of not only reducing the light produced by the low beam light source 2 from passing through the partition 31 from the top downward, producing parasitic light at the partition 31, and interfering the high beam, but also reducing the light produced by the high beam light source 3 from passing through the partition 31 from the bottom upward, producing parasitic light at the partition 31, and interfering the low beam.

According to some of the embodiments of the present invention, the partition 31 and the light guide member 32 are integrally formed into one piece through, for example, molding technologies. Besides, the partition 31 and the light guide member 32 are both transparent. By so, the integrally formed partition 31 and light guide member 32 can facilitate the overall installation of the bifocal lens module 1, wherein some minor and small mounting parts will no longer be required.

According to some other embodiments of the present invention, the materials of the partition 31 and the light guide member 32 are the same, but the partition 31 and the light guide member 32 are separately formed.

According to some other embodiments of the present invention, the materials of the partition 31 and the light guide member 32 are not transparent and the light guide channel 320 is formed through drilling or integrally forming to be arranged on the light guide member 32. Namely, the light guide member 32 is hollow. The inner wall of the light guide member 32 may be coated and plated with some coating layer, such as aluminum plating. The light guide member 32 may also be a transparent and hollow structure with the inner wall thereof being coated and plated with, for example, aluminum plating.

Figure 8:
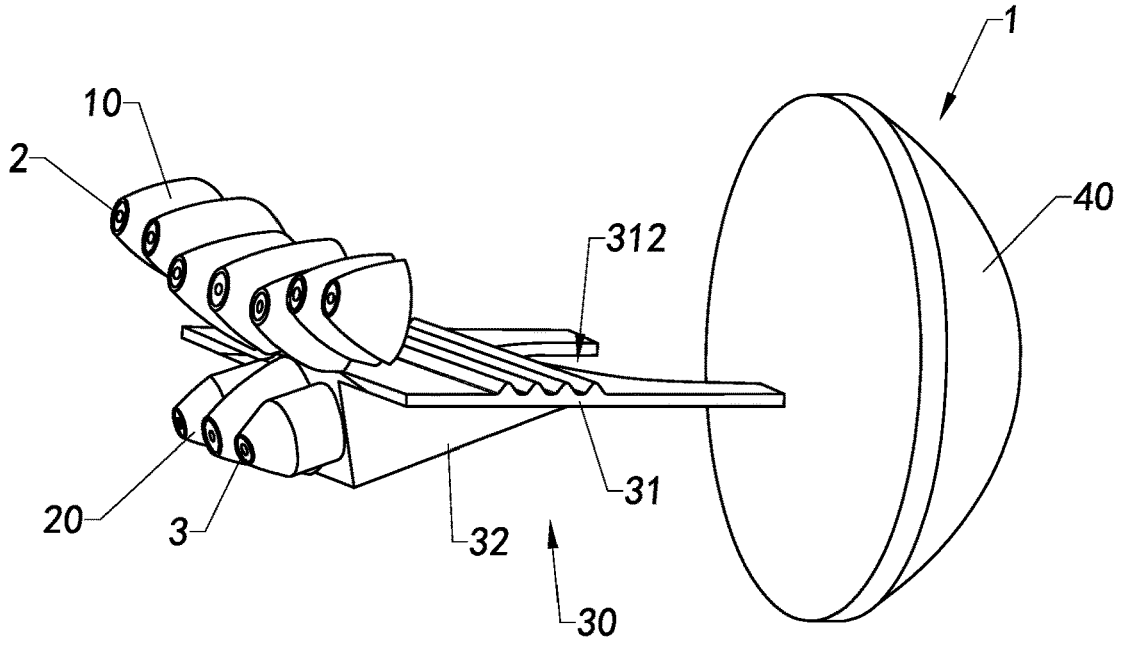
FIG. 8 is a perspective view of the bifocal lens module according to another alternative mode of the above preferred embodiment of the present invention.

Referring to FIG. 8, the bifocal lens module 1 according to another alternative mode of the above preferred embodiment of the present invention is illustrated.

According to the another alternative mode of the preferred embodiment of the present embodiment, the partition 31 of the bifocal lens module 1 is different from the partition 31 of the above embodiment.

According to the another alternative mode of the preferred embodiment of the present embodiment, the upper surface 3111 of the partition 31 is a ripple structure. Namely, the upper surface 3111 of the partition 31 has ups and downs, so as to allow various positions on the upper surface 3111 of the partition 31 to have different reflectance.

When some of the light emitted by the low beam light source 20 hit the upper surface 3111 of the partition 31, the light can be reflected based on the needs.

It is worth noted that the upper surface 3111 of the partition 31 can be arranged based on customer requirements. For example, it may be designed into various shapes in order to achieve some desired optical results or be coated and plated with various coating layers.

According to some other embodiments of the present invention, the partition 31 has the opening 312 and the partition 31 has a hollow-carved design. It is worth noted that the partition 31 mainly utilizes the opening 312 to limit the final illumination result. Hence, if the opening 312 remains unchanged, one may redesign the shape of the partition 31 based on the needs. The partition 31 may be designed larger or smaller as well.

For instance, the partition 31 may be a rectangle based structure that has the opening 312 formed thereon or a triangle based structure that has the opening 312 formed thereon or a circular based structure that has the opening 312 formed thereon.

Further, it is worth noted that the optical lens 40 has a light incoming side and a light projecting side. The light incoming side of the optical lens 40 is utilized for receiving the light, while the light projecting side is utilized for the light to be projected from. The light incoming side and the light projecting side of the optical lens 40 are respectively a curved surface and the light incoming side may be a rough and uneven surface. In other words, the optical lens 40 may have a plurality of apertures formed and arranged on the light incoming side thereof.

According to another aspect of the present invention, the present invention provides an assembling method of the bifocal lens module 1, comprising the following steps:

holding the at least one low beam light source 2, the at least one high beam light source 3, the partition 31, the light guide member 32, and the bifocal lens module 1 at secure positions respectively;

examining an illumination result; and adjusting at least one of the positions of the at least one low beam light source 2, the at least one high beam light source 3, the partition 31, the light guide member 32, and the optical lens 40 if a desired illumination result is not achieved, so as for achieving the desired illumination result.

According to some embodiments of the present invention, in the above method, the curvature of the low beam condenser 10 is adjusted if the desired illumination result is not achieved, so as for achieving the desired illumination result.

According to some embodiments of the present invention, in the above method, the illumination result under the low beam mode is examined, if the illumination result does not meet a predetermined result, one may adjust the position of at least either one of the at least one low beam light source 2, the at least one high beam light source 3, the partition 31, the light guide member 32, and the optical lens 40.

According to some embodiments of the present invention, in the above method, the illumination result under the low beam mode is examined, if the illumination result does not meet the expectation, one may adjust the curvature of the low beam condenser 10.

According to some embodiments of the present invention, in the above method, the illumination result under the high beam mode is examined, if the illumination result does not meet the expectation, one may adjust the position of at least either one of the at least one low beam light source 2, the at least one high beam light source 3, the partition 31, the light guide member 32, and the optical lens 40.

According to some embodiments of the present invention, in the above method, the illumination result under the high beam mode is examined, if the illumination result does not meet the expectation, one may adjust the curvature of the high beam condenser 10 to achieve the ideal illumination result.

According to some embodiments of the present invention, in the above method, the partition 31 and the light guide member 32 are affixed so as to maintain the relative positions of the partition 31 and the light guide member 32 unchanged.

According to some embodiments of the present invention, in the above method, the partition 31 and the light guide member 32 are integrally formed.

According to some embodiments of the present invention, in the above method, the relative positions of the partition 31 and the light guide member 32 are changed so as to change the relative positions of the opening 312 of the partition 31 and the light outlet 3202 of the light guide member 32.

One skilled in the art will understand that the embodiment of the present invention as shown in the drawings and described above is exemplary only and not intended to be limiting. It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A bifocal lens module, comprising:

a low beam condenser;

a high beam condenser;

an optical lens; and a light guide unit, having a curvy end face and an opening, wherein said curvy end face surroundingly forms and defines said opening, wherein said light guide unit defines a light guide channel and a light outlet communicated with said light guide channel, allowing a light to leave said light outlet in a manner of being transmitted in said light guide channel along an upper inclined direction facing toward a focal point of said optical lens, wherein a low light, which is emitted by the at least one low beam light source, is able to be converged through said low beam condenser, transmitted from an upper position of said light guide unit to a bottom of said light guide unit through said opening, and then the low light is sent to a lower part of said optical lens, wherein a high light, which is emitted by the at least one high beam light source, is able to be converged by said high beam condenser, transmitted from a lower position of said light guide unit to a top of said light guide unit through said light guide channel, and then the high light is sent to an upper part of said optical lens.

2. The bifocal lens module, as recited in claim 1, wherein said light guide unit comprises a partition and a light guide member, wherein said opening is formed and defined on said partition and said light guide channel is arranged at said light guide member, wherein said light outlet is provided on said light guide member.

3. The bifocal lens module, as recited in claim 2, wherein said light guide member has a solid structure.

4. The bifocal lens module, as recited in claim 2, wherein said light guide member has a hollow structure, wherein said light guide channel passes through said light guide member.

5. The bifocal lens module, as recited in claim 1, wherein said light guide unit is integrally formed.

6. The bifocal lens module, as recited in claim 1, wherein said light guide unit is transparent.

7. The bifocal lens module, as recited in claim 6, wherein said light guide unit is made of transparent plastic material.

8. The bifocal lens module, as recited in claim 1, wherein said light guide unit comprises a shade layer arranged on an upper surface of said light guide unit.

9. The bifocal lens module, as recited in claim 2, wherein said partition of said light guide unit is made of opaque material.

10. The bifocal lens module, as recited in claim 1, wherein said light guide unit has a bottom surface, wherein a distance between said bottom surface and a central axis of said optical lens is arranged to be gradually reduced when closer to said light outlet.

11. A vehicle headlight, comprising:

a bifocal lens module, which comprises:

a low beam condenser, a high beam condenser, an optical lens, and a light guide unit, having a curvy end face and an opening, wherein said curvy end face surroundingly forms and defines said opening, wherein said light guide unit defines a light guide channel and a light outlet communicated with said light guide channel, allowing a light to leave said light outlet in a manner of being transmitted in said light guide channel along an upper inclined direction facing toward a focal point of said optical lens;

at least one low beam light source, arranged on an upper side of said light guide unit, so as for emitting a low light above said bifocal lens module, such that the low light is converged through said low beam condenser, passes through a focal point of said optical lens, and reaches a lower part of said optical lens; and at least one high beam light source, arranged on a lower side of said light guide unit, so as for emitting a high light below said bifocal lens module, such that the high light is converged through said high beam condenser, passes through said focal point of said optical lens, and reaches an upper part of said optical lens, wherein the low light, emitted by said at least one low beam light source is able to be converged through said low beam condenser, transmitted from an upper position of said light guide unit to a bottom of said light guide unit through said opening, and then the low light is sent to a lower part of said optical lens, wherein the high light, emitted by said at least one high beam light source, is able to be converged by said high beam condenser, transmitted from a lower position of said light guide unit to a top of said light guide unit through said light guide channel, and then the high light is sent to an upper part of said optical lens.

12. The vehicle headlight, as recited in claim 11, further having a low beam mode and a high beam mode, wherein said at least one low beam light source is lightened in said low beam mode, while both said at least one high beam light source and said at least one low beam light source are lightened in said high beam mode, wherein said vehicle headlight is operably switched between said low beam mode and said high beam mode.

13. The vehicle headlight, as recited in claim 11, wherein said at least one low beam light source is arranged on said upper side of the light guide unit in an inclined manner facing toward said light guide unit, so as to allow the low light to be transmitted from above of said light guide unit to underneath of said light guide unit, wherein said at least one high beam light source is arranged on said lower side of the light guide unit in an inclined manner facing toward said light guide unit, so as to allow the high light to be transmitted from underneath of said light guide unit to above of said light guide unit.

14. The vehicle headlight, as recited in claim 11, wherein said light guide unit comprises a partition and a light guide member, wherein said opening is formed and defined on said partition and said light guide channel is arranged at said light guide member, wherein said light outlet is provided on said light guide member.

15. The vehicle headlight, as recited in claim 11, wherein said light guide unit has a bottom surface, wherein a distance between said bottom surface and a central axis of said optical lens is arranged to be gradually reduced when closer to said light outlet.

16. A vehicle, comprising:

a vehicle main body; and at least one vehicle headlight, mounted in front of said vehicle main body, wherein said at least one vehicle headlight comprises:

a bifocal lens module, which comprises:

a low beam condenser, a high beam condenser, an optical lens, and a light guide unit, having a curvy end face and an opening, wherein said curvy end face surroundingly forms and defines said opening, wherein said light guide unit defines a light guide channel and a light outlet communicated with said light guide channel, allowing a light to leave said light outlet in a manner of being transmitted in said light guide channel along an upper inclined direction facing toward a focal point of said optical lens;

at least one low beam light source, arranged on an upper side of said light guide unit, so as for emitting a low light above said bifocal lens module, such that the low light is converged through said low beam condenser, passes through a focal point of said optical lens, and reaches a lower part of said optical lens; and at least one high beam light source, arranged on a lower side of said light guide unit, so as for emitting a high light below said bifocal lens module, such that the high light is converged through said high beam condenser, passes through said focal point of said optical lens, and reaches an upper part of said optical lens, wherein the low light, emitted by said at least one low beam light source is able to be converged through said low beam condenser, transmitted from an upper position of said light guide unit to a bottom of said light guide unit through said opening, and then the low light is sent to a lower part of said optical lens, wherein the high light, emitted by said at least one high beam light source, is able to be converged by said high beam condenser, transmitted from a lower position of said light guide unit to a top of said light guide unit through said light guide channel, and then the high light is sent to an upper part of said optical lens.

17. The vehicle, as recited in claim 16, wherein said at least one vehicle headlight has a low beam mode and a high beam mode, wherein said at least one low beam light source is lightened in said low beam mode, while both said at least one high beam light source and said at least one low beam light source are lightened in said high beam mode, wherein said vehicle headlight is operably switched between said low beam mode and said high beam mode.

18. The vehicle, as recited in claim 16, wherein said at least one low beam light source is arranged on said upper side of the light guide unit in an inclined manner facing toward said light guide unit, so as to allow the low light to be transmitted from above of said light guide unit to underneath of said light guide unit, wherein said at least one high beam light source is arranged on said lower side of the light guide unit in an inclined manner facing toward said light guide unit, so as to allow the high light to be transmitted from underneath of said light guide unit to above of said light guide unit.

19. The vehicle, as recited in claim 16, wherein said light guide unit comprises a partition and a light guide member, wherein said opening is formed and defined on said partition and said light guide channel is arranged at said light guide member, wherein said light outlet is provided on said light guide member.

20. The vehicle, as recited in claim 16, wherein said light guide unit has a bottom surface, wherein a distance between said bottom surface and a central axis of said optical lens is arranged to be gradually reduced when closer to said light outlet.

* * * * *